US007598013B2

(12) United States Patent
Yoshida et al.

(10) Patent No.: US 7,598,013 B2
(45) **Date of Patent: *Oct. 6, 2009**

(54) ELECTROSTATIC IMAGE DEVELOPING TONER

(75) Inventors: Eiichi Yoshida, Tokyo (JP); Masahiko Nakamura, Tokyo (JP); Kaori Soeda, Tokyo (JP); Tomoko Mine, Tokyo (JP); Kenichi Onaka, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 280 days.

This patent is subject to a terminal disclaimer.

(21) Appl. No.: 11/624,768

(22) Filed: Jan. 19, 2007

(65) Prior Publication Data

US 2007/0196759 A1 Aug. 23, 2007

(30) Foreign Application Priority Data

Feb. 17, 2006 (JP) ..... 2006-040448

(51) Int. Cl.
*G03G 9/08* (2006.01)

(52) U.S. Cl. ..... 430/108.4; 430/110.4

(58) Field of Classification Search ..... 430/108.4, 430/110.4

See application file for complete search history.

(56) References Cited

U.S. PATENT DOCUMENTS

| | | | | |
|---|---|---|---|---|
| 5,928,831 | A * | 7/1999 | Nakamura | 430/137.14 |
| 6,261,731 | B1 * | 7/2001 | Iemura et al. | 430/108.3 |
| 2005/0277040 | A1 * | 12/2005 | Michel et al. | 430/108.2 |

FOREIGN PATENT DOCUMENTS

| | | |
|---|---|---|
| JP | 2000214629 | 8/2000 |
| JP | 2000235280 | 8/2000 |
| JP | 2000347445 | 12/2000 |

* cited by examiner

*Primary Examiner*—John L Goodrow
(74) *Attorney, Agent, or Firm*—Lucas & Mercanti, LLP

(57) ABSTRACT

A toner comprising: (i) toner particles, each toner particle comprising a binder resin and a colorant; and (ii) an oxymonocarboxylic acid or a salt thereof, wherein a total content of the oxymonocarboxylic acid or the salt thereof in the toner is 10 to 173 ppm based on the total weight of the toner.

10 Claims, 2 Drawing Sheets

ELECTROSTATIC IMAGE DEVELOPING TONER

TECHNICAL FIELD

The present invention relates to an electrostatic image developing toner (hereinafter referred to simply as a toner) which is employed for image formation based on an electrophotographic system, particularly used in printers and copiers.

BACKGROUND

It is assumed that in the future, needs for color image formation employing electrophotographic image forming apparatuses, represented by laser printers and MFP (multifunctional peripherals), will increase further. In addition, to implement that further spread, down-sizing and easier maintenance are also sought. Mainly employed as color image forming apparatuses to meet the above needs are those which employ a non-magnetic single component developer (or called as a non-magnetic single component toner) capable of forming images without carriers. For example, mainly employed as an image forming method employing the non-magnetic single component developer is one in which a latent image formed on an electrostatic latent image carrying member is developed via a non-magnetic single component developer composed of toner which is conveyed and fed via a developer carrying member such as a development roller, and the formed toner image is transferred onto the transfer material, followed by thermal fixing of the toner image on the transfer material.

Further in recent years, the market demands rapid full-color image formation to produce handout materials for office conferences and POP advertisements. When printing is carried out employing a downsized high rate color printer, toner is demanded to exhibit rapid and consistent initial electrostatic charge increasing capability. As techniques to meet such needs, there is one which realizes rapid initial electrostatic charge increase employing a pulverized toner incorporating, for example, polyester resins, colorants, electrostatic charge controlling agents, and oxidation type polyolefin waxes (refer, for example, to Patent Document 1).

However, the toner disclosed in the above patent adversely affects production cost due to limitation of component materials. Further, the above toner is not always preferable since during continuous printing, the resulting image density tends to gradually decrease due to charge-up.

When the recent technical trend of toner is reviewed, so-called polymerization toners have increasingly been developed which are produced via a process in which resin particles are aggregated in an aqueous medium. The polymerization toner is suited for a production process in which small particles of uniform shape and particle size distribution are produced, whereby it is possible to provide optimal toner for formation of pictorial images (refer, for example, to Patent Document 2).

Further, downsizing image forming apparatuses is progressing. When an apparatus is downsized, impact applied to toner and constituting member tend to increase, whereby investigation to provide devices with higher durability has been conducted. For example, a toner production technique is disclosed which controls hardness of toner particles during particle formation in an aqueous medium (refer, for example, to Patent Document 3).

(Patent Document 1) Japanese Patent Publication Open to Public Inspection (hereinafter referred to as JP-A) No. 2000-235280

(Patent Document 2) JP-A No. 2000-214629

(Patent Document 3) JP-A No. 2000-347445

SUMMARY

However, when the toner disclosed in above Patent Document 3 was loaded in a "downsized non-magnetic single component high rate color printer" and was subjected to a long continuous printing run at low temperature and low humidity, problems occurred in which image density decreased. The increase in printing rate has been realized under downsizing, resulting also in an increase of frequency of production of a large amount of prints, whereby problems, which are not previously occurred, have surfaced.

Furthermore, the working life of the development roller has become problematic. At a high printing rate, the number of prints per week and month markedly increases. In such a case, when a downsized development roller (usually being a small diameter roller) which is the same as conventional ones, replacement frequency of the development roller and development units increases, resulting in an increase in downtime (being an unusable time even though wished to use it) of the printer. The interior temperature of a downsized high rate printer tends to increase, whereby the working life is further shortened due to degradation of the development roller via filming.

An object of the present invention is to provide (1) a toner which can result in no decrease in image density even under long continuous printing runs at low temperature and low humidity, and (2) a toner which can minimizes filming of the development roller, resulting in an extension of the working life of the development roller.

The object of the present invention is achievable, employing the following embodiments.

(1) An aspect of the present invention includes a toner comprising:

(i) toner particles, each toner particle comprising a binder resin and a colorant; and (ii) an oxymonocarboxylic acid or a salt thereof, wherein a total content of the oxymonocarboxylic acid or the salt thereof in the toner is 10 to 173 ppm based on the total weight of the toner.

(2) Another aspect of the present invention includes a toner of the above-described item (1), wherein:

(a) a content of sodium in the toner is 1 to 134 ppm based on the total weight of the toner; and (b) a content of a divalent or a trivalent metal element in the toner is 300 to 1800 ppm based on the total weight of the toner.

(3) Another aspect of the present invention includes a non-magnetic single component toner comprising the toner of the above-described item (1).

Based on the present invention, it becomes possible to produce printed matter of excellent image quality without applying burdens to the development roller and the photoreceptor during image formation. Consequently, the working life of members such as the development roller or the photoreceptor is extended, whereby excellent printed matter is consistently provided for an extended period of time, and maintenance is significantly eased. The above effects are markedly exhibited in a downsized image forming apparatus, employing a non-magnetic single component developer which results in large load applied to members such as the development roller during image formation.

Further, based on the present invention, image density does not decrease even though long continuous printing runs is performed at low temperature and low humidity. Further, a toner incorporating a sodium element of 1-134 ppm and divalent or trivalent metal elements of 300-1,800 ppm tends to result in a decrease in image density at low temperature and low humidity. However, the toner of the present invention incorporating the above elements markedly minimizes a density change during continuous printing at low temperature and low humidity.

DESCRIPTION OF THE PREFERRED EMBODIMENTS

Figure 1:
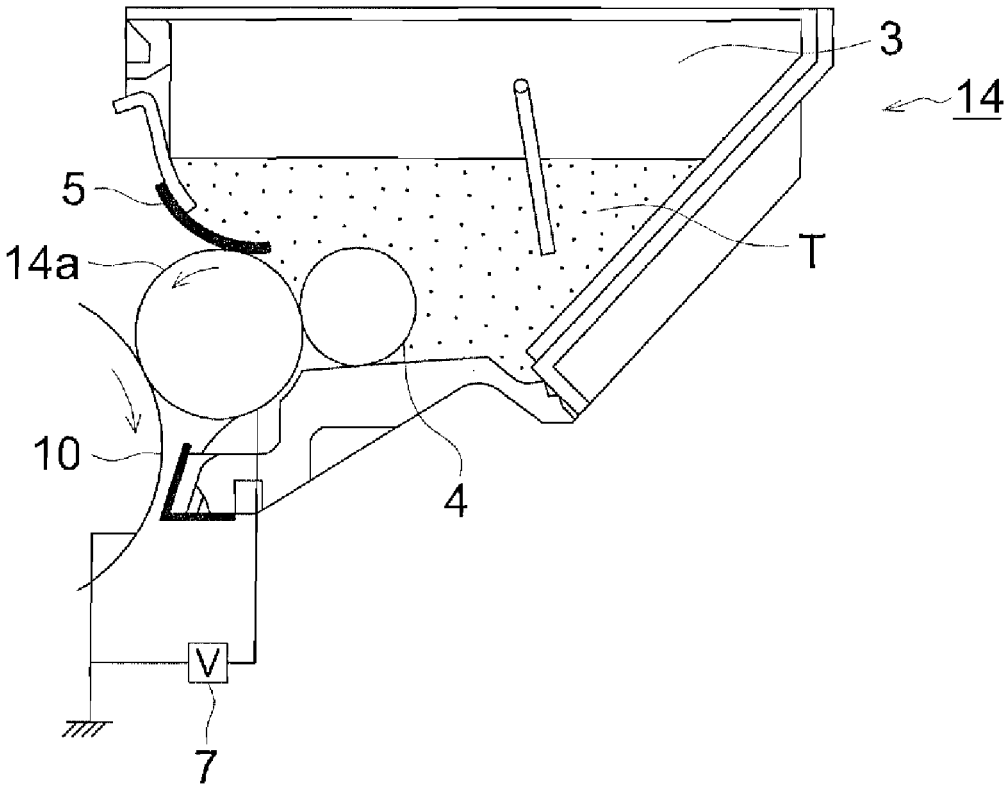
FIG. 1 is a schematic sectional view showing an example of a non-magnetic single-component developer processor.

The present invention relates to toner incorporating an oxymonocarboxylic acid or a salt thereof of a specified amount.

The present invention is capable of consistently providing printed matter of excellent image quality for an extended duration without applying burdens onto the development roller or the photoreceptor, even though image formation is reiterated. The reasons why, as noted above, it has become possible to extend the working life of the photoreceptor and the development roller are assumed to be in such a manner that release of external additives from toner is minimized by an oxymonocarboxylic acid incorporated in the toner. Namely, it is assumed that a strong hydrogen bond is formed between silica and titanium dioxide incorporated as external additives, and oxycarboxylic acid, whereby impact to the development roller and the photoreceptor from the toner is relaxed due to the action of the external additives being firmly held onto the surface of toner particles. Further, it is also assumed that the aforementioned problems are solved in such a manner that release of external additives is retarded whereby adhesion and retention of external additive aggregates formed via released external additives on the development roller and the photoreceptor are minimized. Further, it is assumed that generation of filming is triggered in such a manner that initially, external additives released from toner particles are stuck into the uppermost layer of the development roller and the photosensitive layer of the photoreceptor, and the resulting projections shave the toner, followed by promotion of fusion.

Still further, based on the present invention, a rapid initial electrostatic charge increase of toner is realized, whereby images are assuredly formed employing the toner carrying a stabilized amount of electrostatic charge. The reason is assumed to be as follows. Oxycarboxylic acid incorporated in the toner is thought to be easily mobile on the surface of the toner particle and easily forms a state to occupy the particle surface, whereby impurities including the residues of polymerization initiators such as sulfate ions, which remain on the toner particle surface, are sealed in. Consequently, it is assumed that an increase in electrostatic charge on the surface of the toner particle is minimized to result in a rapid initial electrostatic charge increase.

The present invention will now be detailed.

The toner of the present invention is characterized by incorporating into the aforesaid toner an oxymonocarboxylic acid or a salt thereof in an amount of 10-173 ppm. The preferred amount an oxymonocarboxylic acid or a salt thereof is 20-120 ppm. When the amount is in 10 ppm to 173 ppm, the effect by an oxymonocarboxylic acid or a salt thereof is obtained without affecting the electrostatic charge of the toner inappropriately.

The molecular weight of the oxymonocarboxylic acids is preferably 47-1,500, and more preferably 60-1,000, and still more preferably it is 80-500.

An oxymonocarboxylic acid, as described in the present invention, refers to a compound having one carboxyl group and at least one hydroxyl group in one molecule, and the number of carbon atoms is preferably from 2 to 12.

Salts of oxymonocarboxylic acids according to the present invention refer to compounds in which the H atom in the carboxyl group and a hydroxyl group in oxymonocarboxylic compounds is replaced with the metal atom described above.

In the present invention, it is also possible to employ those compounds which form metal salts by combining a metal ion onto the carboxyl group of the oxymonocarboxylic acid described above. Preferred as metals to form such a salt are univalent metals such as sodium, potassium, or lithium, which are called alkaline metals.

The preferable oxymonocarboxylic acid compounds used in the present invention are represented by Formula (OM):

$$HO—R—COOH, \qquad \text{Formula (OM)}$$

wherein R is a substituted or unsubstituted alkylene group; or a substituted or unsubstituted arylene group. Listed examples of substituents for an alkylene group and an arylene group are; an alkyl group, an aryl group, a hydroxyl group, a carboxyl group, a halogen atom, an ester group, an amino group and an amido group.

Specific examples of oxymonocarboxylic acid compounds usable in the present invention will now be shown below.

(2-1)

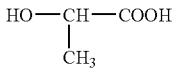

(2-2)

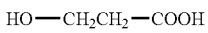

(2-3)

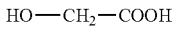

(2-4)

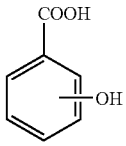

(2-5)

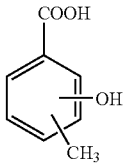

(2-6)

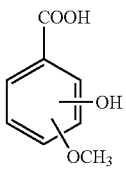

-continued (2-7)

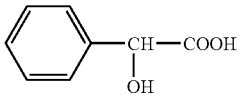

(2-8)

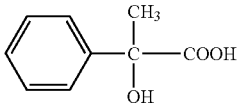

(2-9)

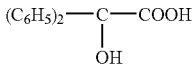

(2-10)

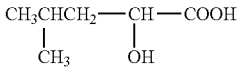

(4-1)

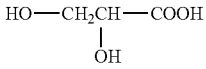

(4-2)

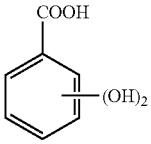

(4-3)

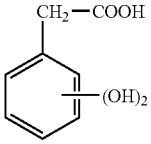

(4-4)

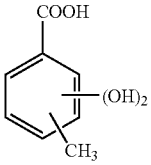

(4-5)

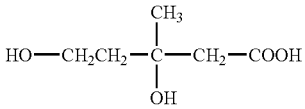

(4-6)

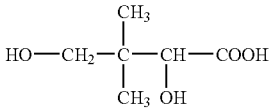

Of the compounds exemplified above, listed as compounds which are preferably employed in the present invention may be (2-2), (2-10), and (4-6).

It is possible to determine the amount of an oxymonocarboxylic acid or a salt thereof incorporated in toner based on the following method.

1. The following extraction operations (1-1)-(1-2) below are carried out for the toner to be measured.

(1-1) Added to 500 mg of a toner is 10 ml of a methanol solution incorporating 1 N hydrochloric acid, and the resulting mixture is dispersed for 15 minutes employing an ultrasonic homogenizer.

(1-2) The resulting dispersion is filtered through a 0.2 μm aperture filter, and the filtrate is diluted by a factor of 10 employing ultra-pure water.

2. The aqueous solution prepared in above (1-2) is analyzed employing ion chromatography under following (2-1) conditions. Structure determination based on the resulting peak is carried out after dispense, employing conventional methods. Specifically, analysis is carried out via matching of the retention time with standard samples, employing mass spectrometry and nuclear magnetic resonance (NMR). When the structure is determined, a calibration curve is prepared employing a standard sample of the same structure. Further, based on comparison of the peak areas, conversion is conducted utilizing the concentration of the extraction liquid from the toner, and the amount of the oxymonocarboxylic acid incorporated in the toner is obtained. When a plurality of oxymonocarboxylic acids is incorporated, the total sum is designated as the amount of oxymonocarboxylic acids incorporated in the toner.

(2-1) Conditions of ion chromatography instrument

Detection: DV 210 nm

Columns: ODS-80TM 4.6×250 mm, produced by TOSOH Corp., and ODS-80TM 4.6×150 mm, produced by TOSOH Corp.

Flow rate: 0.5 ml/minute

Mobile phase: 5 mM ammonium dihydrogenphosphate (at a pH of 2.4)

Column temperature 25° C.

Analysis amount: 20 μl

Analysis time: 45 minutes

The mobile phase is prepared in such a manner that 1.15 g of ammonium dihydrogenphosphate (being a reagent chemical) is dissolved in 1,980 g of ion-exchanged water, followed by adjustment of pH to 2.40 employing 85% by weight normal phosphoric acid, and further, ion-exchanged water is added while stirring to bring the total weight to 2.000 g.

It is preferable that the toner of the present invention incorporates a sodium element at 1-134 ppm.

It is also preferable that the toner of the present invention incorporates a di- or a trivalent metal element at 300-1,800 ppm, but it is more preferable that it incorporates the same at 600-1,400 ppm. Listed as divalent metal elements may be calcium, magnesium, manganese, and copper. Listed as trivalent metal elements may be aluminum and iron.

Measurement of the amount of metal elements incorporated in toner is carried out employing an inductively coupled plasma-atomic emission spectrophotometer (ICP).

It is possible to achieve quantitative analysis of metal elements incorporated in toner based on the following procedure.

Initially, 1 g of toner is weighed, to which 1.5 ml of sulfuric acid is added. The resulting mixture undergoes carbonization employing microwaves. Subsequently, 0.5 ml of nitric acid and 1.5 ml of hydrogen peroxide are added to the carbonized sample, and the resulting mixture undergoes decomposition employing microwaves. The decomposed sample is then dissolved in distilled water, and the resulting solution is accurately collected in a 50 ml measuring flask.

The aqueous solution in the measuring flask is analyzed employing an inductively coupled plasma-atomic emission spectrophotometer, whereby the content of di- or trivalent metal elements in the toner is quantitatively analyzed.

Examples of the inductively coupled plasma atomic emission spectrophotometer include ICP emission spectrophotometer "SPS 7800 SERIES, SPS 3100 SERIES, and SPS 5100 SERIES", (produced by Seiko Instruments Inc., SII Nanotechnology Co., Ltd.), and ICP emission analyzer "CIROS Mark II" (produced by Rigaku Corp.).

Physical properties of the toner of the present invention will now be described.

(Volume Based Median Diameter ($D_{50}$))

The volume based median diameter ($D_{50}$) of the toner of the present invention is preferably 3-9 μm.

It is possible to determine and calculate the volume based median diameter ($D_{50}$) and the variation coefficient in the volume based particle size distribution of toner, employing an instrument which is composed of MULTISIZER 3 (produced by Beckmann-Coulter Co.) connected to a data processing computing system (produced by Beckman-Coulter Co.).

Measurement procedures are as follows. After taming 0.02 g of toner with 20 ml of a surface active agent solution (for example, a surface active agent solution, aimed at dispersing the toner), which is prepared by diluting a neutral detergent incorporating surface active agent components by a factor of 10), the mixture is subjected to microwave dispersion for one minute, whereby a toner dispersion is prepared. The resulting toner dispersion is injected into a beaker carrying ISOTON II (produced by Beckman-Coulter Co.) in the sample stand until reaching a measurement concentration of 8% by weight, and measurement is carried out while setting the count of the instrument at 2,500. The employed aperture diameter of COULTER MULTISIZER is 50 μm.

(Variation Coefficient in Volume Based Particle Size Distribution)

The variation coefficient in the volume based size distribution of the toner particles of the present invention is preferably 8-21%, but is more preferably 10-19%.

The variation coefficient in the volume based size distribution is calculated based on the following formula.

$$\text{Variation coefficient in the volume based size distribution (\%)} = (S2/Dn) \times 100$$

wherein S2 represents a standard deviation in the volume based size distribution, and Dn represents volume based median diameter ($D_{50}$).

(Average Circularity)

The average circularity of the toner particles of the present invention is preferably 0.951-0.990.

The circularity of a toner particle is defined by the following formula.

$$\text{Circularity} = (\text{circumferential length of a circle having the same projective area as that of a particle image})/(\text{circumferential length of the projective particle image})$$

Further, the average circularity refers to the value which is obtained by dividing the sum of circularity of each particle by the number of all particles.

The circularity of toner particles refers to the value determined employing "FPIA-2100" (produced by Sysmex Corp.). In practice, toner particles are tamed with an aqueous solution incorporating surface active agents and subjected to ultrasonic dispersion for one minute. The resulting dispersion is measured employing "FPIA-2100". Measurement is carried out under such conditions that the number of HPF detections is set at 3,000-10,000 to result in the optimal concentration while set at the HPF (high magnification imaging) mode.

(Production Method of Toner)

Production methods of the toner according the present invention are not particularly limited, but a production method is preferred in which resin particles are formed via an emulsion polymerization method and toner is prepared via a process which aggregates the resulting resin particles.

One example of the toner production method will be detailed in which toner is produced via a process which aggregates resins particles. Processes for adding oxymonocarboxylic acid are not limited, but it is preferably added in process (2) described below. However, since some is washed away during process (4), it is preferable that based on a preliminary experiment, the amount of the oxymonocarboxylic acid added to toner is estimated.

The toner according to the present invention is produced via the following processes; (1) a polymerization process in which polymerizable monomers are polymerized to prepare a resin particle dispersion, (2) an aggregation process (hereinafter referred to as a resin particle aggregating process) in which intermediate toner particles which become a host of toner, is formed by aggregating toner particle-constituting materials such as resin particles or colorant particles in an aqueous medium, (3) a shape controlling process which follows the resin particle aggregation process and under stirring and heating, completes fusion of materials which constitute the toner intermediate and controls the shape, (4) a solid-liquid separation and washing process which separates the formed intermediate toner particles from the aqueous medium and washes the surface of the intermediate toner particles, (5) a drying process which dries the intermediate toner particles, which is a process via the solid-liquid separation and washing process, and (6) an external additive addition process in which a toner usable for image formation is prepared by adding external additives to the dried toner particle intermediate.

Each of the above processes will now be described.

(Polymerization Process)

An appropriate example of the polymerization process is as follows. A radically polymerizable monomer solution is added to an aqueous medium incorporating surface active agents, and liquid droplets are formed via application of mechanical energy. Subsequently, in the above liquid droplet, a polymerization progress employing radicals generated from water-soluble radical polymerization initiators. Resin particles may be incorporated, as nucleolus particles, in the above aqueous medium.

It is preferable that the molecular distribution is controlled in such a manner that polymerization is divided into several stages upon varying the amount of chain transfer agents. Resin particles are prepared by the above polymerization process.

Resin particles, prepared as above, may incorporate either releasing agents (being waxes) or colorants. Colored resin particles are prepared by polymerizing a monomer composition incorporating colorants.

Further, when non-colored resin particles are employed, during the aggregation process described below, a colorant particle dispersion is added to a resin particle dispersion, whereby it is possible to prepare intermediate toner particles (being a toner host) by aggregating the resin particles and the colorant particles.

(Resin Particle Aggregation Process)

This process corresponds to "the process in which resin particles are aggregated in an aqueous media to result in growth" in the present invention. Further, in the present invention, it is preferable to add either or both of the oxymonocarboxylic acid or the salt thereof to the aqueous medium during this process, namely during progress of resin particle aggregation. In this process, by aggregating resin particles prepared in the polymerization process with toner particle constituting materials such as colorant particles, formed are intermediate toner particles (being pre-particles which are provided with function as a toner via the final process such as addition of external additives, also called a toner host or colored particles). Further, during this process, fusion (melt adhesion) in addition to aggregation is carried out in which aggregated particles are firmly combined with each other via action such as heating.

It is preferable that fusion of resin particles and colorants is carried out along with aggregation. Alternatively, after completing aggregation, fusion may be carried out immediately employing means such as heating.

Specifically, by adding di- or trivalent metal salts to an aqueous medium, electrostatic repulsion force between particles such as resin particles and colorant particles is relaxed to enable aggregation, whereby these particles are subjected to aggregation and also growth to form intermediates toner particles. Aggregated particles are combined with each other under the action of heat to result in fusion. As noted above, the toner particle intermediates are formed and allowed to grow.

In this process, the added amount of an oxymonocarboxylic acid or a salt thereof is preferably 0.8-2.8 parts by weight with respect to 100 parts by weight of the aqueous medium. By controlling the above added amount within the above range, it is possible to more assuredly exhibit the effects of the present invention.

The process for aggregating resin particles will be further described. In the resin particle aggregating process, as noted above, resin particles formed during the polymerization process and colorant particles are aggregated, and simultaneously, the above particles are fused at a temperature equal to or higher than the glass transition temperature of the resin particles.

A method for aggregating particles is known in which a resin particle dispersion and a colorant particle dispersion are blended at a temperature equal to or lower than the glass transition temperature of the resin particles, and during particle aggregation the aggregated particles are fused upon raising the temperature, whereby simultaneously, particles are aggregated. By employing this method, it is possible to proceed with fusion while particles grow, resulting in advantages in which it is possible to easily and uniformly control the particle shape as well as the particle size distribution.

Based on the above aspects, it is preferable to employ a method called "salting-out/fusion method" in which during the process for aggregating resin particles, aggregation and fusion are simultaneously carried out to grow particles to the desired particle diameter, and if desired, heating is continued to control the particle shape.

"Aqueous medium", described in the present invention, refers to a composition in which the main component (being at least 50% by weight) is composed of water. Listed as components other than water are water-soluble organic solvents, which include, for example, methanol, ethanol, isopropanol, butanol, and acetone.

Further, particle aggregation is accelerated by the addition of metal salts, such as divalent salts. Examples of metal salts which accelerate the aggregation include salts of univalent alkaline metals such as sodium, potassium, or lithium; salts of divalent metals such calcium, magnesium, manganese, and copper; and salts of trivalent metal such as aluminum and iron. Specific examples include sodium chloride, potassium chloride, lithium chloride, calcium chloride, magnesium chloride, zinc chloride, copper sulfate, magnesium sulfate, and manganese sulfate.

Of these metal salts, particularly preferred are divalent metal salts since they can progress aggregation in a small addition amount.

It is preferable that the added amount of these metal salts is to result in a concentration of the metal salts in an aqueous medium of at more than or equal to the critical aggregation concentration. In practice, the added amount is commonly at least a factor of 1.2 of the critical aggregation concentration, but is preferably a factor of 1.5. "Critical aggregation concentration", as described herein, is an index related to the stability of the aqueous dispersion. The critical aggregation concentration can be precisely calculated employing the method, for example, described in Seize Okamura, "Kobunshi Kagaku (Polymer Chemistry), Vol. 116, page 601 (1960), edited by Polymer Gakkai)". Further, salts are added to a dispersion to be aggregated while varying the concentration. The $\xi$ (zeta) potential of each of the resulting dispersions is determined, and the salt concentration at which the above $\xi$ potential varies may be determined as the critical aggregation concentration.

Further, during the resin particle aggregating process, it is possible to aggregate resin particles and colorant particles together with toner particle constituting materials such as wax, fixing aids, or electrostatic charge controlling agents.

(Shape Controlling Process)

In the toner production method according to the present invention, during above resin particle aggregating, after adding an oxymonocarboxylic acid or a salt thereof process, continuously, heating and stirring are carried out to control the shape of the intermediate toner particles (being toner hosts). Namely, by extending the heating and stirring duration, it is possible to control the shape of the intermediate toner particles (being their hosts) to be nearly spherical.

(Solid-Liquid Separation/Washing Process)

During the solid-liquid separation/washing process, carried out are a solid-liquid separation process in which the above intermediate toner particles (being toner hosts) are subjected to solid-liquid separation from the intermediate toner particle (being toner host) dispersion cooled to the specified temperature in the above process and a washing process in which impurities such as surface active agents or salting-out agents are removed from a toner cake (being a lump aggregated in the form of a cake of the intermediate toner particles (being toner hosts) in a wet state).

During the washing process, water-washing is carried out until the filtrate reaches an electric conductivity of 10 μs/cm.

Solid-liquid separation and the washing processes include, but are not limited, to a vacuum filtration method employing a Buchner funnel and a method employing a filter press.

(Drying Process)

The drying process is one for drying the washed intermediates toner. Generally, drying is carried out in a cake state. Listed as dryers employed in this process may be a spray drier, a vacuum freeze drier, and a vacuum drier. It is preferable to employ a static tray drier, a mobile type tray drier, a fluid layer drier, a rotary type drier, or a stirring type drier. The moisture in the dried intermediate toner particles is preferably at most 5% by weight, but is more preferably at most 2% by weight. When the dried intermediate toner particles (being toner hosts) are weakly aggregated due to attractive force between the particles, the resulting aggregates may be crushed. Employed as a crushing apparatus may be mechanical ones such as a jet mill, a HENSCHEL mixer, a coffee mill, or a food processor.

(External Additive Addition Process)

This process is one which prepares toner usable for image formation via incorporation of external additives in the dried toner particle intermediates.

Employed as an external additive mixer may be mechanical ones such as a HENSCHEL mixer or a coffee mill.

Materials (components) employed in the present invention will now be described.

Binding resins to constitute resin particles preferably incorporate vinyl polymers and can be prepared by polymerizing polymerizable monomers. Listed as polymerizable monomers employed for polymerization are those having a carboxyl group, and polymerizable monomers which are employed in combination with those having a carboxyl group.

Specifically listed as polymerizable monomers having a carboxyl group are methacrylic acid esters such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, dimethylaminoethyl methacrylate, or dimethylaminoethyl methacrylate; acrylic acid ester derivatives such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, or phenyl acrylate; as well as acrylic acids or methacrylic acid derivatives such as acrylonitrile, methacrylonitrile, or acrylamide.

Further listed as polymerizable monomers employed in combination with polymerizable monomers having a carboxyl group are styrene or styrene derivatives such as styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, or p-n-dodecylstyrene; olefins such as ethylene, propylene, or isobutylene; vinyl esters such as vinyl propionate, vinyl acetate, or vinyl benzoate; vinyl ethers such as vinyl methyl ether or vinyl ethyl ether; vinyl ketones such as vinyl methyl ketone, vinyl ethyl ketone, or vinyl hexyl ketone; N-vinyl compounds such as N-vinylcarbazole, N-vinylindole, or N-vinylpyrrolidone; and vinyl compounds such as vinylnaphthalene and vinylpyridine.

It is further preferable to employ in combination with compounds having an ionic dissociation group as polymerizable monomers constituting resins. Examples include compounds having a substituent such as a carboxyl group, a sulfonic acid, or a phosphoric acid as a monomer constituting group, and specific examples include acrylic acid, methacrylic acid, maleic acid, itaconic acid, cinnamic acid, fumaric acid, monoalkyl maleate, monoalkyl itaconate, styrenesulfonic acid, allysulfosuccinic acid, 2-acrylamido-2-methylpropnesulfonic acid, and acid phosphoxyethyl methacrylate.

Further, it is possible to prepare crosslinking structure resins employing multifunctional vinyls such as divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol dimethacrylate, or neopentyl glycol diacrylate.

Further, when an emulsion association method is employed, it is preferable to employ water-soluble radical polymerization initiators. Listed as such water-soluble polymerization initiators may be persulfates such as potassium persulfate or ammonium persulfate, azobisaminodipropane acetates, azobiscyanovaleric acid and salts thereof, or hydrogen peroxide.

The molecular weight of resins constituting the toner of the present invention is preferably 1,000-100,000 in terms of number average molecular weight (Mn), and also preferably 2,000-100,000 in terms of weight average molecular weight (Mw). It is possibly to calculate the molecular weight of resins constituting toner based, for example, on a gel filtration chromatographic method or a permeation chromatographic method.

The molecular weight determination based on the gel permeation chromatographic method (hereinafter also referred to as GPC) will now be described.

Determination of molecular weight is carried out employing the following procedure. Initially, 1 mg of the resin to be measured is added to 1 ml of a tetrahydrofuran solution. The resulting mixture is stirred employing a magnetic stirrer to result in sufficient dissolution of the resin, and the resulting mixture is filtered employing a 0.45-0.50 pore size membrane filter to prepare a sample for GPC measurement. Subsequently, after heating the measurement column for GPC to 40° C. and stabilizing it, tetrahydrofuran is flowed at a rate of 1 ml per minute and 100 μl of a sample to be measured at a concentration of 1 mg/ml is injected, followed by the desired determination. It is preferable to employ measurement columns in such a manner that commercial polystyrene gel columns are in combination. Examples include the combinations of SHODEX GPC KF-801, -802, -803, -804, -886, and -807, produced by Showa Denko K. K., Ltd. and G1000H, G2000H, G3000H, G4000H, G5000H, G6000H, G7000H, TSK GUARD COLUMN, produced by TOSOH Corp. Further, it is preferable to employ, as a detector, a refractive index detector (being an IR detector) or a UV detector.

The number average molecular weight or weight average molecular weight of tetrahydrofuran-soluble components in resin particles is represented by a styrene-converted molecular weight. The styrene-converted molecular weight is obtained based on a styrene calibration curve. It is recommended to make the styrene calibration curve by determining the molecular weight of about 10 standard polystyrene resins.

(Colorants)

It is possible to employ, as colorants usable in the present invention, inorganic or organic colorants known in the art. Specific colorants are listed below.

Employed as black colorants are, for example, carbon blacks such as furnace black, channel black, acetylene black, thermal black, or lamp black, as well as magnetic powders such as magnetite or ferrite.

Further, listed as colorants for magenta or red are C. I. Pigment Red 2, C. I. Pigment Red 3, C. I. Pigment Red 5, C. I. Pigment Red 6, C. I. Pigment Red 7, C. I. Pigment Red 15, C. I. Pigment Red 16, C. I. Pigment Red 48:1, C. I. Pigment Red 53:1, C. I. Pigment Red 57:1, C. I. Pigment Red 122, C. I. Pigment Red 123, C. I. Pigment Red 139, C. I. Pigment Red 144, C. I. Pigment Red 149, C. I. Pigment Red 166, C. I. Pigment Red 177, C. I. Pigment Red 178, and C. I. Pigment Red 222.

Further listed as pigments for orange or yellow are C. I. Pigment Orange 31, C. I. Pigment Orange 43, C. I. Pigment Yellow 12, C. I. Pigment Yellow 13, C. I. Pigment Yellow 14, C. I. Pigment Yellow 15, C. I. Pigment Yellow 74, C. I. Pigment Yellow 93, C. I. Pigment Yellow 94, and C. I. Pigment Yellow 138.

Further listed as pigments for green or cyan are C. I. Pigment Blue 15, C. I. Pigment Blue 15:2, C. I. Pigment Blue 15:3, C. I. Pigment Blue 15:4, C. I. Pigment Blue 16, C. I. Pigment Blue 60, and C. I. Pigment Blue 62, C. I. Pigment Blue 66, and C. I. Pigment Blue 7.

If desired, these colorants may be employed individually or in combinations of at least two selected types. Further, the added amount of colorants is commonly in the range of 1-30% by weight with respect to the total toner, but is preferably in the range of 2-20% by weight.

(Chain Transfer Agents)

In order to regulate the molecular weight of resins, it is possible to employ common chain transfer agents. Employed transfer agents are not particularly limited and examples include mercaptans such as n-octylmercaptan, n-decylmercaptan, or tert-dodecyl mercaptan, mercaptopropionates such as n-octyl-3-mercapotopropionate, as well as terpinorene and α-methylstyrene dimers.

(Waxes)

In the present invention, waxes known in the art are usable.

Examples of such waxes include polyolefin waxes such as polyethylene wax or polypropylene wax; long hydrocarbon chain based waxes such as paraffin wax or sazole wax; dialkyl ketone based waxes such as distearyl ketone; ester based waxes such as carnauba wax, montan wax, trimethylolpropane tribehenate, pentaerythritol tetrabehenate, pentaerythritol tetrastearate, pentaerythritol diacetate dibehenate, glycerin tribehenate, 1,18-octadecanediol distearate, tristearyl trimellitate, or distearyl maleate; and amido based waxes such as trimellitic acid tristearylamide.

The amount of waxes incorporated in toner is preferably 1-20% by weight with respect to the total toner, but is more preferably 3-15% by weight.

(Electrostatic Charge Controlling Agents)

If desired, it is possible to incorporate electrostatic charge controlling agents in the toner of the present invention. Compounds known in the art may be used as the above electrostatic charge controlling agents.

(External Additives)

Listed as inorganic particles employed as external additives may be those known in the art. In practice, preferably employed may be minute silica particles, minute titania particles, and minute alumina particles, as well as composite oxides thereof. These minute inorganic particles are preferably hydrophobic.

Listed as minute organic particles usable as external additives may be minute spherical particles at a number average diameter of the primary particles of about 10-2,000 nm. Listed as constituting materials of such minute organic particles may be polystyrene, polymethyl methacrylate, and styrene-methyl methacrylate copolymers.

It is possible to employ the toner of the present invention as either a single component developer or a double component developer.

When employed as a single component developer, listed is a non-magnetic single component toner or a magnetic single component toner incorporating magnetic particles at a size of about 0.1-0.5 μm, and both types may be employed.

Further, upon being blended with carriers, toner may be employed as a double component developer. Employed as carriers may be magnetic particles, known in the art, which are composed of metals such as iron, ferrite, or magnetite and alloys of aluminum or lead with the above metals. Of these, ferrite particles are particularly preferred. The diameter of the above carrier particles is preferably 20-100 μm, but is more preferably 25-80 μm.

In view of downsizing of the development apparatus and a decrease in cost, it is preferable to employ toner in the form of the non-magnetic single component developer.

An image forming apparatus which forms toner images, employing the toner of the present invention, will now be described.

Description will be made with reference to one example of the development method employing a non-magnetic single component toner as the toner of the present invention, however the present invention is not limited thereto.

FIG. 1 is a schematic sectional view showing one example of a development unit for a non-magnetic single component developer.

In FIG. 1, 14 is a development unit for a non-magnetic single component developer, and 10 is a latent image carrying body (being a photoreceptor drum). A latent image is formed via an electrophotographic process means or an electrostatic recording means (not shown). Further, **14*a*** is a development roller, which is composed of an aluminum or stainless steel non-magnetic sleeve.

Raw aluminum or stainless steel pipe may be employed as the development roller without any modification. However, preferred are those in which the surface is uniformly roughened by blowing glass beads onto the surface, which are subjected to a specular surface treatment, or which are coated with resins.

Toner T is stored in hopper 3, and is supplied onto a toner carrying body employing supplying roller 4. The supplying roller is composed of a porous cellular medium such as polyurethane foam, rotates in the normal or reverse direction at a relative rate. It supplies toner and also removes the toner (being the toner which was not employed for development) after development on the toner carrying body. The toner supplied onto the toner carrying body is uniformly coated to result in a thin layer, employing toner regulating blade 5 which is one type of a thin toner layer formation regulating member.

The effective contact pressure between the toner regulating blade and the toner carrying body is preferably 3-250 N/m in terms of linear pressure in the sleeve bus bar direction, but is more preferably 5-12 N/m. When the contact pressure is at most 3 N/m, it becomes difficult to uniformly coat toner and the electrostatic charge amount of the toner is broadened resulting in fogging and toner scattering. On the other hand, when it exceeds 250 N/m, relatively large pressure is applied to the toner resulting in degradation of the toner, whereby the toner particles aggregate. Namely, by controlling the contact pressure within the range of 3-250 N/m, it is possible to effectively loosen aggregated toner and further, it is possible to instantaneously increase the electrostatic amount of the toner.

The thin toner layer formation regulating member includes an elastic blade and an elastic roller. It is preferable to employ materials in the triboelectric series suitable for charging toner to a desired polarity.

In the present invention, silicone rubber, urethane rubber, and styrene-butadiene rubber are appropriate. Further, provided may be an organic resin layer composed of polyamide, polyimide, nylon, melamine, melamine-crosslinked nylon, phenol resins, fluorine based resins, silicone resins, polyester resins, urethane resins, or styrene based resins. Further, it is preferable to employ electrically conductive rubber and electrically conductive resins or to disperse, into the rubber and resins of the blade, fillers and charge controlling agents such as metal oxides, carbon blacks, inorganic whiskers, or inorganic fibers, since appropriate dielectric property and electric charge providing property are provided, whereby the toner is appropriately charged.

In a system in which a thin toner layer is coated onto a development roller employing a blade, in order to achieve sufficient image density, it is preferable that the thickness of the toner layer on the development roller is controlled to be less than the distance between the development roller and the photoreceptor drum, and an alternating electric field is applied to the above gap. Namely, by applying to the gap, between development roller 14*a* and photoreceptor drum 10, an alternating electric field employing the bias power source 7 shown in FIG. 1 or development bias which is generated by superposing direct current electric field to the alternating electric field, movement of the toner from the development roller to the photoreceptor drum is facilitated, whereby it is possible to prepare higher quality images.

The toner of the present invention is suitably employed for an image forming method including a fixing process in which a transfer material on which a toner image is formed is passed between a heating roller and a pressure roller, constituting a fixing apparatus.

Figure 2:
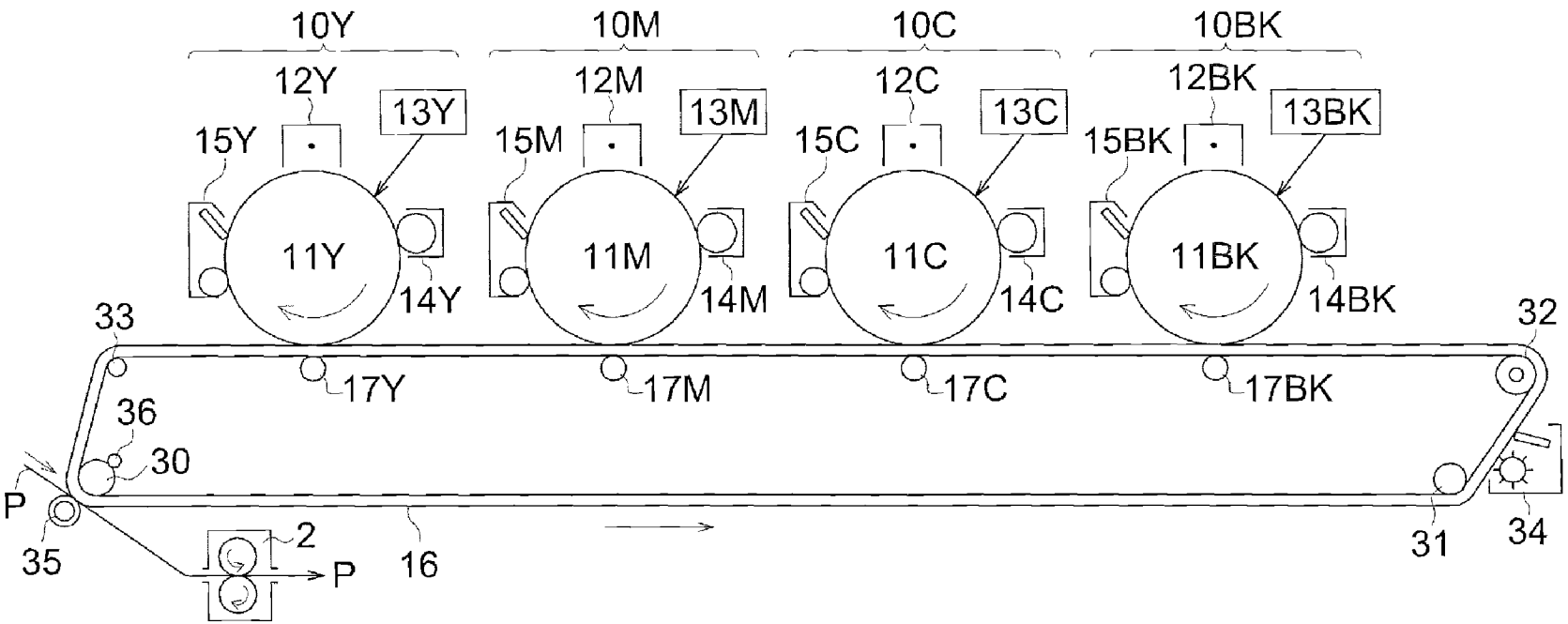
FIG. 2 is a schematic sectional view showing an example of a full-color image forming apparatus which forms images employing the toner of the present invention.

FIG. 2 is a sectional view showing one example of the structure of a full-color image forming apparatus which forms images employing the toner of the present invention.

The full-color image forming apparatus shown in FIG. 2 is provided with units 10Y, 10M, 10C, and 10Bk, looped belt-shaped intermediate transfer body 16, transfer rollers 17Y, 17M, 17C, and 17Bk, transfer material conveying roller 18, and fixing unit 2. In the present invention, provided as the material of belt-shaped intermediate transfer body 16 is the belt-shaped intermediate transfer body according to the present invention. In the present invention, polyimide resins are employed as the belt material of the looped belt of fixing unit 2, described below.

In each of units 10Y, 10M, 10C, and 10Bk, each of photoreceptor drums 11Y, 11M, 11C, and 11Bk is provided which can rotate clockwise at a specified peripheral rate (being the processing rate). Around each of photoreceptor drums 11Y, 11M, 11C, and 11Bk, each of corotron charging units 12Y, 12M, 12C, and 12Bk, exposure units 13Y, 13M, 13C, and 14Bk, individual color development units (yellow development unit 14Y, magenta development unit 14M, cyan development unit 14C, and black development unit 14Bk), and photoreceptor cleaners 15Y, 15M, 15C, and 15Bk are arranged.

All four units 10Y, 10M, 10C, and 10Bk are arranged to be parallel to intermediate transfer belt 16, but it is possible to arrange them in an appropriate order such as a unit order of 10Bk, 10Y, 10C, and 10M, to match the image forming method.

Intermediate belt 16 can rotate counterclockwise, as shown by the arrow, employing back-up roller 30 and supporting rollers 31, 32, and 33 at the same peripheral rate as that of each of photoreceptor drums 11Y, 11M, 11C, and 11Bk, and some of the supporting rollers positioned between supporting rollers 32 and 33 are arranged to come into contact with each of photoreceptor drums 11Y, 11M, 11C and 11Bk. Intermediate transfer belt 16 is provided with belt cleaning unit 34. Supporting roller 31 also functions as a tensioning roller and is arranged to shift toward the intermediate transfer belt 16 direction, whereby it is possible to regulate the tension of intermediate transfer belt 16.

Transfer rollers 17Y, 17M, 17C, and 17Bk are located in the interior of intermediate transfer belt 16, each of them is arranged to face the position at which each of photoreceptor drum 11Y, 11M, 11C and 11Bk is brought into contract with intermediate transfer belt 16, whereby the primary transfer section (being a nip section), which transfer a toner image on each of photoreceptor drums 11Y, 11M, 11C, and 11Bk to intermediate transfer belt 16, is formed.

Bias roller 35 is arranged on the surface which carries the toner image of intermediate transfer belt to face back-up roller 30 via intermediate transfer belt 16. The secondary transfer section (being a nip section) is formed employing bias roller 35 via above intermediate transfer belt 16 and back-up roller 30. Further, back-up roller 30 is provided with electrode roller 26 which rotates under pressure contact with above back-up roller 30.

Fixing unit 2 is arranged so that it is possible to convey transfer material P after passing the above secondary transfer section.

In unit 10Y of the image forming apparatus shown in FIG. 2, photoreceptor drum 11Y is rotated and simultaneously, corotron charging unit 12Y is driven. Thus, the surface of photoreceptor drum 11Y is uniformly charged at the specified polarity and electric potential. Photoreceptor drum 11Y, the surface of which is uniformly charged, is subsequently exposed imagewise employing exposure unit 13Y, whereby an electrostatic latent image is formed on its surface.

Subsequently, the above electrostatic latent image is developed via yellow development unit 14Y, resulting in formation of a toner image on the surface of photoreceptor drum 11Y.

During passage through the primary transfer section (being the nip section) of photoreceptor drum 11Y and intermediate transfer belt 16, the resulting toner image is successively subjected to primary transfer onto the periphery of intermediate transfer belt 16 due to the electric field formed by the transfer bias applied from transfer roller 17Y.

Thereafter, any residual toner on photoreceptor drum 11Y is removed by photoreceptor cleaner 15Y. Resulting photoreceptor drum 11Y is provided for the subsequent transfer cycle.

The above transfer cycle is carried out in the same manner as in each of units 10M, 10C, and 10Bk, and a second color toner image, a third color toner image, and a fourth color toner image are successively formed and superposed onto intermediate belt 16, resulting in formation a full-color toner image.

The full-color toner image transferred onto intermediate belt 16 is conveyed via rotation of transfer belt 16 to the secondary transfer section (being the nip section) in which bias roller 35 is arranged.

Transfer material P is conveyed between intermediate transfer belt 16 and bias roller 35 of the secondary transfer section at specified timing. The toner image, carried on above intermediate transfer belt 16, is transferred onto transfer material P via pressure contact conveyance employing bias roller 35 and back-up roller 30, as well as rotation of intermediate transfer belt 16.

Transfer material P, onto which the toner image has been transferred, is conveyed to fixing unit 2, and the toner image is fixed via pressure application/heating process. Intermediate transfer belt 16, which has completed transfer, is subjected to removal of residual toner employing belt cleaning unit 34 provided downstream of secondary transfer section.

Polyimide resins are preferably employed to prepare the intermediate transfer belt of the image forming apparatus and the endless belt of the fixing unit according to the present invention.

(Transfer Materials)

Transfer materials employed in the present invention are supports carrying toner images, which are commonly called image supports, transfer materials, or transfer paper. It is possible to specifically list various transfer materials such as plain paper ranging from thin paper to cardboard, top-quality paper, coated printing paper such as art paper or coated paper, commercial Japanese paper, postcard paper, OHP plastic films, and fabrics, however the transfer materials are not limited thereto.

EXAMPLES

Embodiments of the present invention will now be specifically described with reference to examples, however the present invention is not limited thereto.

<Preparation of Resin Particle Dispersion 1>

In a separable flask fitted with a stirrer, a temperature sensor, a cooling pipe, a nitrogen introducing unit, and a stirrer, 97.0 parts by weight (including an effective component of 2.6 parts by weight) of an aqueous sodium dodecylsulfate solution were dissolved in 1,510 parts by weight of ion-exchanged water, whereby "Aqueous Medium 1" was prepared. Thereafter, a mixture of the following components was added to "Aqueous Medium 1".

| | |
|---|---|
| Styrene | 213 parts by weight |
| n-Butyl acrylate | 62 parts by weight |
| Acrylic acid | 7 parts by weight |
| Pentaerythritol tetrastearate | 154 parts by weight |

The initiator solution formulated as described below was added to above "Aqueous Medium 1", and the resulting mixture was heated to 82.5° C. to undergo polymerization over two hours.

A mixed monomer solution incorporating the following components was added:

| | |
|---|---|
| Aqueous hydrogen peroxide solution (at an effective component of 2.5 parts by weight) | 42 parts by weight |
| Aqueous sodium erythorbate solution (at an effective component of 6.5 parts by weight) | 42 parts by weight |
| n-Octylmercaptan | 0.6 part by weight |

Subsequently, the following monomer mixture solution was added:

| | |
|---|---|
| Styrene | 542 parts by weight |
| n-Butyl acrylate | 157 parts by weight |
| Acrylic acid | 18 parts by weight |

Further, the following initiator solution was added:

| | |
|---|---|
| Aqueous hydrogen peroxide solution (at an effective component of 9 parts by weight) | 145 parts by weight |
| Aqueous sodium erythorbate solution (at an effective component of 23.5 parts by weight) | 153 parts by weight |
| n-Octylmercaptan | 8.2 parts by weight |

Further, 48 parts by weight of an aqueous sodium dodecylsulfate solution (at and effective component of 4.8 part by weight) was added. The resulting mixture was heated to 90° C. and underwent while stirring over one hour, whereby a resin particle dispersion was prepared. The resulting dispersion was designated as "Resin Particle Dispersion 1".

<Preparation of Colorant Dispersion>

A colorant particle dispersion was prepared in such a manner that C. I. Pigment Red 122, as a magenta colorant, was dispersed into ion-exchanged water to result in a solid concentration of 12.5% by weight. The resulting dispersion was designated as "Colorant Particle Dispersion".

<<Preparation of Toner>>

<Preparation of Toner 1>>

Charged into a separable flask fitted with a thermometer, a cooling pipe, a nitrogen introducing unit, and a stirrer were 1,700 parts by weight (in terms of solids) of "Resin Particle Dispersion", 2,100 parts by weight of ion-exchanged water and 250 parts by weight of "Colorant Particle Dispersion". Further, while maintaining the temperature of the system at 30° C., the pH was adjusted to 10 by the addition of an aqueous sodium hydroxide solution (at 25% by weight).

Subsequently, an aqueous solution, in which 54.3 parts by weight of magnesium chloride were dissolved in 104.3 parts by weight of ion-exchanged water, was added. Thereafter, the temperature of the system was raised to 75° C. to initiate an aggregation reaction between the resin particles and colorant particles. After initiation of the aggregation reaction, sampling was periodically carried out, and volume based median diameter ($D_{50}$) of particles was determined employing a size distribution measurement instrument, "COULTER MULTISIZER 3" (produced by Beckman-Coulter Co.). When the median diameter reached 5.8 μm, 10.5 parts by weight of Exemplified Compound (2-2) were added, followed by stirring.

When the circularity of particles reached 0.976, the temperature in the system was lowered to 30° C. to terminate the aggregation reaction, whereby a dispersion, "Colored Particles 1" was prepared. Resulting "Colored Particles 1" exhibited a volume based median diameter ($D_{50}$) of 5.8 μm and a variation coefficient of volume based size distribution of 18.8.

Subsequently, "Colored Particles 1" dispersion was subjected to solid-liquid separation employing a basket type centrifuge, "MARK III TYPE" (Type No. 60×40)(produced by Matsumoto Machine Group Co., Ltd.), whereby a wet cake of "Colored Particles 1" was formed. Thereafter, washing and solid-liquid separation of "Colored Particles 1" were repeated until the electric conductivity of the filtrate reached at most 15 μS/cm.

The final wet cake was placed in a flash drier, "FLASH JET DRIER" (produced by Seishin Kikaku Co.) and "Colored Particles 1" were dried until its moisture reached 0.5% by weight. Drying was carried out via blown air at 40° C. and 20% relative humidity.

While employing a "HENSCHEL MIXER" (produced by Mitsui Miike Chemical Industry Co., Ltd.), hydrophobic silica at a number average diameter of the primary particles of 12 nm and a degree of hydrophobicity of 68, and hydrophobic titanium oxide at a number average diameter of the primary particles of 80 nm and a degree of hydrophobicity of 63 were added to dried "Colored Particles 1" to result in a concentration of 1% by weight and 1% by weight, respectively, whereby "Toner 1" was prepared.

The volume based median diameter ($D_{50}$) and the variation coefficient of a volume based size distribution of resulting "Toner 1" were the same as the above measured values.

<Preparation of Toner 2>

"Toner 2" was prepared in the same manner as "Toner 1", except that the aqueous solution prepared by dissolving 54.3 parts by weight of magnesium hexahydrate in 104.3 parts by weight of ion-exchanged water was replaced with an aqueous solution prepared by dissolving 108.6 parts by weight of magnesium chloride hexahydrate in 160.8 parts by weight of ion-exchanged water, and when the volume based median diameter ($D_{50}$) of particles reached 3.1 μm, after initiation of aggregation reaction between the resin particles and the colorant particles, 12.4 parts by weight of Exemplified Compound (2-2) were added.

<Preparation of Toner 3>

"Toner 3" was prepared in the same manner as "Toner 1", except that the aqueous solution prepared by dissolving 54.3 parts by weight of magnesium hexahydrate in 104.3 parts by weight of ion-exchanged water was replaced with an aqueous solution prepared by dissolving 162.9 parts by weight of magnesium chloride hexahydrate in 198.0 parts by weight of ion-exchanged water, and when the volume based median diameter ($D_{50}$) of particles reached 9.9 μm, after initiation of the aggregation reaction between the resin particles and the colorant particles, 85.7 parts by weight of Exemplified Compound (2-2) were added.

<Preparation of Toner 4>

"Toner 4" was prepared in the same manner as "Toner 1", except that the aqueous solution prepared by dissolving 54.3 parts by weight of magnesium hexahydrate in 104.3 parts by weight of ion-exchanged water was replaced with an aqueous solution prepared by dissolving 45.7 parts by weight of aluminum sulfate in 104.3 parts by weight of ion-exchanged water, and 10.5 parts by weight of Exemplified Compound (2-2) were replaced with 30.6 parts by weight of the sodium salt of Exemplified Compound (2-2).

<Preparation of Toner 4B>

"Toner 4B" was prepared in the same manner as "Toner 1", except that the aqueous solution prepared by dissolving 54.3 parts by weight of magnesium hexahydrate in 104.3 parts by weight of ion-exchanged water was replaced with an aqueous solution prepared by dissolving 45.7 parts by weight of aluminum sulfate in 104.3 parts by weight of ion-exchanged water, and 10.5 parts by weight of Exemplified Compound (2-2) were replaced with 45.2 parts by weight of the sodium salt of Exemplified Compound (2-2).

<Preparation of Toner 5>

"Toner 5" was prepared in the same manner as "Toner 1", except that the aqueous solution prepared by dissolving 45.7 parts by weight of aluminum sulfate in 104.3 parts by weight of ion-exchanged water was replaced with an aqueous solution prepared by dissolving 91.4 parts by weight of aluminum sulfate in 160.8 parts by weight of ion-exchanged water, and when the volume based median diameter ($D_{50}$) of particles reached 7.5 μm after initiation of the aggregation reaction between the resin particles and the colorant particles, 18.1 parts by weight of Exemplified Compound (2-10) were added.

<Preparation of Toner 6>

"Toner 6" was prepared in the same manner as "Toner 5", except that the aqueous solution prepared by dissolving 45.7 parts by weight of aluminum sulfate in 104.3 parts by weight of ion-exchanged water was replaced with an aqueous solution prepared by dissolving 137.1 parts by weight of aluminum sulfate in 201.3 parts by weight of ion-exchanged water, and when the volume based median diameter ($D_{50}$) of particles reached 4.0 μm after initiation of the aggregation reaction between the resin particles and the colorant particles, 23.8 parts by weight of Exemplified Compound (2-10) were added.

<Preparation of Toner 7>

"Toner 7" was prepared in the same manner as "Toner 6", except that 23.8 parts by weight of the sodium salt of Exemplified Compound (2-10) were replaced with 42.1 parts by weight of the sodium salt of Exemplified Compound (2-10).

<Preparation of Toner 7B>

"Toner 7B" was prepared in the same manner as "Toner 6", except that 23.8 parts by weight of the sodium salt of Exemplified Compound (2-10) were replaced with 45.3 parts by weight of the sodium salt of Exemplified Compound (2-10).

<Preparation of Toner 8>

"Toner 8" was prepared in the same manner as "Toner 1", except that 10.5 parts by weight of Exemplified Compound (2-2) were replaced with 20.2 parts by weight of Exemplified Compound (4-6).

<Preparation of Toner 9>

"Toner 9" was prepared in the same manner as "Toner 8", except that 20.2 parts by weight of Exemplified Compound (4-6) were replaced with 26.2 parts by weight of the sodium salt of Exemplified Compound (4-6).

<Preparation of Toner 10>

"Toner 10" was prepared in the same manner as "Toner 8", except that 20.2 parts by weight of Exemplified Compound (4-6) were replaced with 46.5 parts by weight of the sodium salt of Exemplified Compound (4-6).

<Preparation of Toner 11>

"Toner 11" was prepared in the same manner as "Toner 5", except that the added amount of Exemplified Compound (2-10) was changed to 14.6 parts by weight.

<Preparation of Toner 12>

"Toner 12" was prepared in the same manner as "Toner 8", except that the added amount of Exemplified Compound (4-6) was changed to 9.2 parts by weight.

<Preparation of Toner 13>

"Toner 13" was prepared in the same manner as "Toner 5", except that the added amount of Exemplified Compound (2-10) was changed to 24.0 parts by weight.

<Preparation of Toner 14>

"Toner 14" was prepared in the same manner as "Toner 1", except that when the volume based median diameter ($D_{50}$) of particles reached 5.8 μm after initiation of the aggregation reaction between the resin particles and the colorant particles, 10.5 parts by weight of Exemplified Compound (2-2) were replaced with 24.0 parts by weight of Comparative Compound (A) having the following structure.

$$HOOC—(CH_2)_2—COOH \qquad \text{Comparative Compound (A)}$$

<Preparation of Toner 15>

"Toner 15" was prepared in the same manner as "Toner 1", except that when the volume based median diameter ($D_{50}$) of particles reached 5.8 μm after initiation of the aggregation reaction between the resin particles and the colorant particles, 10.5 parts by weight of Exemplified Compound (2-2) were replaced with 43.2 parts by weight of Comparative Compound (B) having the following structure.

Comparative Compound (B)

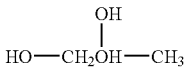

Table 1 shows oxymonocarboxylic acid compounds or comparative compounds employed to prepare "Toners 1-15", added amounts during toner preparation, amounts incorporated in toner, sodium content, content of divalent or trivalent metal, and volume based median diameter ($D_{50}$) of toner.

TABLE 1

| | Toner Preparation | | Content in Toner | | | |
|---|---|---|---|---|---|---|
| Toner No. | Oxymonocarboxylic Acid Compound or Comparative Compound | Added Amount (parts by weight) | Oxymonocarboxylic Acid Compound or Comparative Compound (ppm) | Sodium (ppm) | Divalent or Trivalent Metal (ppm) | Volume Based Median Diameters ($D_{50}$) (μm) |
| Toner 1 | 2-2 | 10.5 | 8 | 2 | 600 | 5.8 |
| Toner 2 | 2-2 | 12.4 | 10 | 2 | 622 | 3.1 |
| Toner 3 | 2-2 | 85.7 | 65 | 2 | 613 | 8.9 |
| Toner 4 | 2-2 (Na) | 30.6 | 115 | 134 | 1792 | 5.8 |
| Toner 4B | 2-2 (Na) | 45.2 | 170 | 198 | 1785 | 5.8 |
| Toner 5 | 2-10 | 18.1 | 14 | 1 | 621 | 5.8 |
| Toner 6 | 2-10 (Na) | 23.8 | 89 | 65 | 1285 | 5.8 |
| Toner 7 | 2-10 (Na) | 42.1 | 158 | 115 | 1794 | 5.8 |
| Toner 7B | 2-10 (Na) | 45.3 | 170 | 124 | 1790 | 5.8 |
| Toner 8 | 4-6 | 20.2 | 15 | 1 | 611 | 5.8 |
| Toner 9 | 4-6 (Na) | 26.2 | 98 | 78 | 697 | 5.8 |
| Toner 10 | 4-6 (Na) | 46.5 | 173 | 120 | 694 | 5.8 |
| Toner 11 | 2-10 | 14.6 | 5 | 1 | 1871 | 5.8 |
| Toner 12 | 4-6 | 9.2 | 7 | 2 | 1826 | 5.8 |
| Toner 13 | 2-10 | 24.0 | 180 | 3 | 296 | 5.8 |
| Toner 14 | Comparative Compound (A) | 24.0 | 90 | 3 | 602 | 5.8 |
| Toner 15 | Comparative Compound (B) | 43.2 | 90 | 4 | 617 | 5.8 |

<<Non-Magnetic Single Component Developer>>

"Toners 1-15", prepared as above, were employed as non-magnetic single component developers.

<<Evaluation>>

<Image Forming Apparatus>

Evaluation was carried out as follows. A commercial color laser printer, "MAGICOLOR 5430DL" (produced by Konica Minolta Business Technologies, Inc.) was modified to make it possible to only employ a magenta toner for output and to increase the printing rate (being the linear rate) approximately two times (300 mm/second), compared to that set for commercial use. Thus, evaluation was performed under higher specifications. The reasons of evaluation employing only the magenta toner were that an evaluation mode was made in which it was easier to detect the problems to be solved by the present invention, especially development roller filming being easily detected (filming generation was easily noticed). Needless to say, the above evaluation was employed to simply exemplify the effects of the present invention, and effects are neither limited nor degraded.

When the residual toner in the toner cartridge became small, the printer was stopped and the toner was fed. Thus, evaluation was carried out without exchanging the development roller.

<Evaluation Items>

(Decrease in Image Density at Low Temperature and Low Humidity)

At 10° C. and 20% relative humidity, printing was carried out on 5,000 A4 size top-quality paper sheets and a decrease in image density at low temperature and low humidity was evaluated based on the measurement of image density on the first sheet and the 5,000th sheet. The image density was determined employing reflection densitometer "RD-918" (produced by Macbeth Co.).

Evaluation Criteria

A: the decrease in image density of the 5,000th print from that of the first print was less than 0.01, being evaluated as excellent B: the decrease in image density on the 5,000th print from that of the first print was less than 0.04, being evaluated as good C: the decrease in image density on the 5,000th print from that of the first print was at least 0.04, being evaluated as poor (Filming on the Development Roller)

At high temperature and high humidity (30° C. and 80% relative humidity), an image at a pixel ratio of 2% (halftone) was printed, and uneven density of halftone, which was generated at pitches of the development roller was visually inspected and the number of sheets resulting in uneven halftone density was evaluated based on the following criteria.

Evaluation Criteria

A: neither filming nor uneven density at the pitches of the development roller was generated until the 100,000th print B: slight filming was generated on from the 5,000th print to the 10,000th print, but no uneven density at the pitches of the development roller was generated until the 100,000th print C: filming was generated between the 2,000th print and the 5,000th print, and slight uneven density at the pitches of the development roller was generated after the 5,000th print D: filming was generated prior to the 2,000th print, and uneven density at the pitches of the development roller was generated in halftone (Toner Scattering)

By employing the aforementioned printer for evaluation, 100,000 prints were produced, and toner scattering was visually observed and the degree of hand staining was also observed when an operator exchanged the development unit.

Evaluation Criteria

A: no toner scattering was noted, and hands were not stained at all when the operator exchanged development units B: adhesion of toner scattered onto the upper lid near the development roller was noted, but hands were not at all stained when the operator exchanged development units C: adhered scattered toner on the upper lid near the development roller was noted D: toner scattering was noted to such a degree that it was necessary for the operator to clean hands after exchanging development units Table 2 shows the evaluation results.

TABLE 2

| | | Evaluation Result | | |
|---|---|---|---|---|
| | Toner No. | Filming of Development Roller | Decrease in Density at Low Temperarure and Low Humidify | Toner Scattering |
| Example 1 | Toner 2 | B | A | A |
| Example 2 | Toner 3 | B | A | A |
| Example 3 | Toner 4 | B | A | A |
| Example 3B | Toner 4B | B | A | A |
| Example 4 | Toner 5 | A | A | A |
| Example 5 | Toner 6 | A | A | A |
| Example 6 | Toner 7 | A | A | A |
| Example 6B | Toner 7B | A | A | A |
| Example 7 | Toner 8 | A | A | A |
| Example 8 | Toner 9 | A | A | A |
| Example 9 | Toner 10 | A | A | A |
| Comparative Example 1 | Toner 1 | C | C | B |
| Comparative Example 2 | Toner 11 | D | C | B |
| Comparative Example 3 | Toner 12 | D | C | C |
| Comparative Example 4 | Toner 13 | C | B | C |
| Comparative Example 5 | Toner 14 | D | B | C |
| Comparative Example 6 | Toner 15 | D | D | D |

As can be seen from the evaluation results of Table 2, "Toners 2-10" of Examples 1-9 resulted in good grades in all the evaluation items, while "Toners 1 and 11-15" of Comparative Examples 10-15 resulted in problematic grades in at least one of the evaluation items.

What is claimed is:

1. A toner comprising:

toner particles, each of the toner particles comprising a binder resin; a colorant; and an oxymonocarboxylic acid or a salt thereof, wherein a total amount of the oxymonocarboxylic acid or the salt thereof in the toner is 10 to 173 ppm based on the total weight of the toner, and the oxymonocarboxylic acid is represented by Formula (OM):

HO—R—COOH, Formula (OM)

wherein R is a substituted or unsubstituted alkylene group; or a substituted or unsubstituted arylene group.

2. The toner of claim 1, wherein:

(a) a content of sodium in the toner is 1 to 134 ppm based on the total weight of the toner; and (b) a content of a divalent or a trivalent metal element in the toner is 300 to 1800 ppm based on the total weight of the toner.

3. The toner of claim 1, wherein:

the amount the oxymonocarboxylic acid or a salt thereof is 20-120 ppm.

4. The toner of claim 1, wherein:

the molecular weight of the oxymonocarboxylic acid is 47 to 1,500.

5. The toner of claim 1, wherein:

the molecular weight of the oxymonocarboxylic acid is 60 to 1,000.

6. The toner of claim 1, wherein:

the oxymonocarboxylic acid has one carboxyl group and at least one hydroxy group in one molecule, and the number of carbon atoms is from 2 to 12.

7. The toner of claim 1, having a variation coefficient in the volume based size distribution of the toner particles of 5 to 21%.

8. The toner of claim 1, having an average circularity of the toner particles being 0.951-0.990, wherein the average circularity is defined by the following formula;

Circularity=(circumferential length of a circle having the same projection area as that of a particle image)/(circumferential length of the projective particle image).

9. A non-magnetic single component toner comprising the toner of claim 1.

10. The toner of claim 1, wherein the oxymonocarboxylic acid is at least one of the following listed compounds:

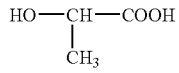
(2-1)

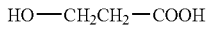
(2-2)

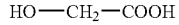
(2-3)

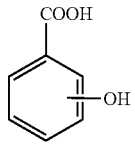
(2-4)

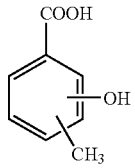
(2-5)

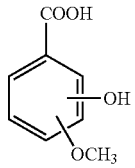
(2-6)

-continued
(2-7)
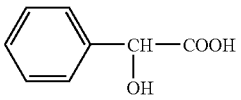
(2-8)
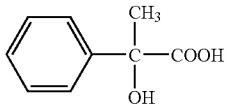
(2-9)
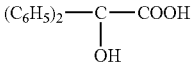
(2-10)
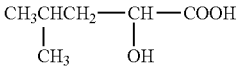
(4-1)
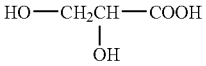
(4-2)
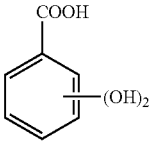
-continued
(4-3)
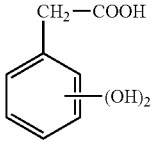
(4-4)
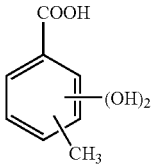
(4-5)
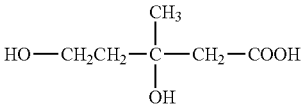
(4-6)
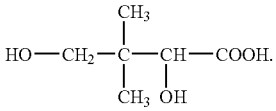
* * * * *